US006160564A

United States Patent [19]

Ohira et al.

[11] Patent Number: 6,160,564

[45] Date of Patent: Dec. 12, 2000

[54] COLOR ELECTROSTATIC RECORDER WITH ADJUSTABLE PRESSURE ON A RECORDING MEDIUM

[75] Inventors: Toshiaki Ohira, Tokyo; Toshitatsu Kawatsu; Kiyotsugu Takasawa, both of Nagano; Fumito Komatsu, Shiojiri, all of Japan

[73] Assignee: Nippon Steel Corporation, Tokyo, Japan

[21] Appl. No.: 09/065,049

[22] PCT Filed: Oct. 29, 1996

[86] PCT No.: PCT/JP96/03163

§ 371 Date: Apr. 27, 1998

§ 102(e) Date: Apr. 27, 1998

[87] PCT Pub. No.: WO97/16316

PCT Pub. Date: May 9, 1997

[30] Foreign Application Priority Data

Oct. 30, 1995 [JP] Japan ..... 7-281843
Oct. 30, 1995 [JP] Japan ..... 7-281844

[51] Int. Cl.[7] ..... B41J 2/385; B41J 2/395; G01D 15/06; G03G 15/01

[52] U.S. Cl. ..... 347/117; 347/149

[58] Field of Search ..... 347/117, 115, 347/139, 140, 149

[56] References Cited

U.S. PATENT DOCUMENTS 5,063,398 11/1991 Murai et al. ..... 347/115
5,745,142 4/1998 Liston ..... 347/117 X

FOREIGN PATENT DOCUMENTS 0 202 140 A1 11/1986 European Pat. Off. .
0 614 130 A2 9/1994 European Pat. Off. .
2-35452 2/1990 Japan .
6-167860 6/1994 Japan .

OTHER PUBLICATIONS

Patent Abstracts of Japan, vol. 009, No. 009 (P–327), 1985 & JP 59 155871 A (Canon KK), 1984.
Patent Abstracts of Japan, vol. 018, No. 557 (P–1817), 1994 & JP 06 202430 A (Canon Inc), 1994.
Patent Abstracts of Japan, vol. 014, No. 428 (M–1025), 1990 & JP 02 169262 A (Canon Inc), 1990.

*Primary Examiner*—Susan S. Y. Lee
*Attorney, Agent, or Firm*—Pollock, Vande Sande & Amernick, RLLP

[57] ABSTRACT

A color electrostatic recorder of a single path system includes electrostatic recording heads conveyed in sliding contact with a recording medium for forming electrostatic latent images, developers provided in pairs to the electrostatic recording heads for developing the electrostatic latent images, and adjustable sliding contact of the recording medium with the electrostatic recording heads. The electrostatic recording heads and developer are provided in series as required, the radii of surface curvature in the electrostatic recording heads are made larger on the downstream side in the moving direction of a recording medium than on the upstream side, and the pressure of electrostatic recording heads on the recording medium is adjustable according to the type of the recording medium.

26 Claims, 6 Drawing Sheets

COLOR ELECTROSTATIC RECORDER WITH ADJUSTABLE PRESSURE ON A RECORDING MEDIUM

FIELD OF THE INVENTION

The present invention relates to a single-path color electrostatic recorder for forming an electrostatic latent image on a record face of a recording medium such as paper, film or cloth concerning primary colors, by using an electrostatic recording head and developing the medium with liquid toner. More particularly, the invention relates to a color electrostatic recorder with a back rest mechanism for bringing a record medium into sliding contact with an electrostatic recording head under moderate pressure.

BACKGROUND OF THE INVENTION

By forming an electrostatic latent image on a recording medium such as paper, film or cloth with the aid of an electrostatic recording head and thereafter developing the medium with liquid toner, the electrostatic recorder records the image. On a record face of the recording medium, a spacer including silica particles on the order of several $\mu$m in diameter is scattered. By pressing the recording medium against the electrostatic head from the opposite side with a pad roller and bringing the record face into sliding contact with the head surface under a moderate pressure, a discharge gap due to the spacer takes place at an appropriate space between the electrostatic head and the dielectric layer in the recording medium. In this state, occurrence of a discharge between electrodes corresponding to individual images of the electrostatic recording head leads to a charging of the recording medium in accordance with an item of image information, so that an electrostatic image is formed. Onto the recording medium having passed the electrostatic head, liquid toner in which toner particles are distributed is applied with a toner roller. When the liquid toner is applied onto the recording medium, toner particles charged in the opposite polarity to the electrostatic latent image are attracted to the electrostatic latent image formed on the recording medium by the electrostatic power and combined with the surface layer of the recording medium, so that the electrostatic latent image is developed.

With a single-path color electrostatic recorder, the above-mentioned electrostatic recording heads are generally provided respectively for four primary colors, cyan, magenta, yellow and black. The above-mentioned four colors are recorded only by one-time carrying, so that a color image is obtained.

As clear from the above, the formation of an electrostatic latent image with an electrostatic recording head must be precisely carried out to accomplish an appropriate image recording in the electrostatic recorder. Accordingly, it becomes important to bring the recording medium into sliding contact with the electrostatic recording head under appropriate pressure. An insufficient pressure would lead to a dropout phenomenon wherein the image to be recorded is interrupted halfway; on the other hand, an excessive press would lead to a spurious writing phenomenon that an image comes to be recorded in a portion not to be printed by nature.

With a general electrostatic recorder, a pad roller is provided at an opposed position to the surface of an electrostatic recording head, and the record face of the recording medium is pressed against the surface of the electrostatic recording head by using the pad roller with the recording medium interposed between it and the electrostatic recording head. When the recording medium is carried during the recording, the pad roller rolls and the recording medium is always kept in sliding contact with the surface of the electrostatic recording head under a constant pressure. An apparatus for pressing the recording medium against the electrostatic recording head by using an elastic member with the recording medium interposed between it and the opposed electrostatic recording head as described above is generally called a backrest. The backrest includes an apparatus for butting a semicylindrical pad alone against the surface in addition to one using a pad roller.

FIGS. 4A and 4B are sectional views showing the outline of a backrest using a pad roller 12. Electrodes for forming an electrostatic latent image are arranged in the main scan direction (perpendicular to the paper face). The electrostatic recording head 11 has main electrodes 13*a*, 13*b* and auxiliary electrodes 14*a*, 14*b* linearly embedded in the center and on the both sides thereof, respectively. The sectional shape of the electrostatic recording head 11 is an upward convex arc. The mutual space is approx. 0.2 mm and approx. 3 mm between the main electrodes and between the auxiliary electrodes. The recording medium 10 is pressed downward by the pad roller 12 serving as a backrest and is conveyed in the arrowhead direction while keeping the record face in sliding contact with the surface of the electrostatic recording head 11. The recording medium 10 is conveyed in the subscanning direction (arrowhead direction) by the winding force of the winding roller disposed the utmost downstream while kept in sliding contact with the surface of a head by using a pad roller 12 serving as a backrest. At that time, a reverse back tension is applied to the recording medium.

Incidentally, FIGS. 4A and 4B depicts a deformation of the pad roller due to the press in exaggeration. The pad roller is formed by wrapping soft rubber on the surface of a metal core and the actual deformation is considerably smaller than shown in FIGS. 4A and 4B. The electrostatic recording head itself also is bent upward convexly and accordingly the butting width of the pad roller. The electrostatic recording head is on the order of several mm.

The broken lines shown in FIGS. 4A and 4B are curves showing a change in the pressed force of the recording medium at individual positions of the recording head. As shown in FIG. 4A, the pressure applied to the recording medium reaches a peak at the center of the head in which the deformation of the pad roller is large and decreases with a departure from the peak. Also, as shown in FIG. 4B, with the movement of the pad roller 12 from the center of the head, the peak position of the pressed pressure varies.

Accordingly, when the recording medium is pressed onto the electrostatic recording head by using the pad roller, not only the pressed pressure but also the installed position becomes important. Furthermore, since the most suitable pressure for recording depends on the material and thickness of a recording medium, the electric properties of a dielectric layer, the condition of a spacer distributed on the surface, and so on, the appropriate pressure also greatly differs with the type of a recording medium.

With a conventional electrostatic recorder, however, when a recording medium is caught with the pad roller against the electrostatic recording head, the position of the pad roller is fixed and the position and pressure against the recording material cannot be changed. Accordingly, once a recorder is fabricated so as to adjust the pressure of a pad roller to a certain type of recording medium in the fabrication step, the adjustment of the pressed pressure cannot be performed by a user. Print on another recording medium requiring a different pressure without adjustment would generate an image noise such as dropout or spurious writing. To prevent this, it was necessary to readjust the apparatus at the maker side and a flexible countermeasure corresponding to the type of recording media was difficult.

On the other hand, the pressure on the head surface of a recording medium depends on the magnitude of a tension applied in the conveyance direction of the recording medium when the push due to the backrest from behind is constant. Namely, the tension applied to the recording medium is parallel to the tangential direction of the electrostatic recording head 11 and the vertical downward force of this tension contributes to the pressure on the head surface of the recording medium. Thus, with a larger tension applied to the recording medium, the pressure on the head surface increases, whereas the pressure on the head surface decreases with a smaller tension applied to the recording medium.

To achieve an appropriate image recording in an electrostatic recorder, first of all, the formation of an electrostatic latent image must be precisely conducted. For that purpose, it becomes important that the record face of the recording medium comes into sliding contact with the head surface under a moderate pressure. In other words, an insufficient pressure of the recording medium would lead to a dropout phenomenon wherein the image to be recorded is interrupted halfway; on the other hand whereas an excessive pressure would lead to a spurious writing phenomenon wherein an image comes to be recorded in a portion not to be printed by nature.

With a color electrostatic recorder of the single path system, a recording medium comes into sliding contact with surfaces of individual electrostatic recording heads provided in series, equal in number to primary colors, and the frictional force, to which the recording medium is subjected in parallel to the conveyance direction during the sliding contact with the respective electrostatic recording heads, comes to be a resistance to the winding force of a winding roller. In addition, before the recording medium which has been developed after a liquid toner is applied thereto arrives to the next electrostatic recording head, an excess of residual liquid toner is sucked and removed with a suction device. This suction operation causes a resistance to the winding force of the winding roller.

As described above, with a color electrostatic recorder of the single path system, many factors causing a resistance to the winding force in the course of conveyance of the recording medium are involved, so that the tension applied to the recording medium is small upstream and increases with an advance to the downstream side. Thus, there was a problem that a dropout was apt to occur in the color image recorded at the upstream side and a spurious writing was apt to occur in the color image recorded at the downstream side.

SUMMARY OF THE INVENTION

The present invention is made in consideration of the problems mentioned above in the prior art, and it is an object of the present invention to provide a color electrostatic recorder with the backrest mechanism enabling the pressure on of a recording medium in sliding contact with an electrostatic recording head to be easily adjustable according to the type of the recording medium.

Another object of the present invention is to provide a color electrostatic recorder so arranged that each color image is recorded appropriately in the single path system.

To attain the above objects, a color electrostatic recorder according to the present invention includes recording heads conveyed in sliding contact with a recording medium for forming an electrostatic latent image, development means provided in pairs to the electrostatic recording heads for developing the electrostatic latent image mentioned above and means for adjusting the sliding contact of the recording medium with the respective electrostatic recording heads, wherein the electrostatic recording heads and development means are disposed and provided at such a number as required in recording of color image.

In this color electrostatic recorder, the respective sliding contact adjustment means having different radii of surface curvature are provided for an individual electrostatic recording head and the pressure each electrostatic recording head at the center is made adjustable.

In the single path system, in which a plurality of pairs of electrostatic recording heads and development means are disposed in series and a color image can be obtained by forming and developing the electrostatic latent images for the respective colors in individual pairs.

The above-mentioned radii of surface curvature in electrostatic recording heads are made larger for the downstream side in the moving direction of the recording medium than for the upstream side.

In addition, in the backrest mechanism the sliding contact adjustment means includes press means for pressing the recording medium against the surfaces of electrostatic recording heads and press adjustment means for adjusting the pressure of electrostatic recording heads at the center.

Furthermore, a plurality of pairs of electrostatic recording heads and development means are grouped according to the moving direction of the recording medium, and the above-mentioned radii of surface curvature in electrostatic recording heads are made larger for the downstream group than for the upstream group.

To attain the above objects, a color electrostatic recorder according to the present invention includes press means for pressing the recording medium against the surface of electrostatic recording heads by their loads so that the respective record faces of the conveyed recording medium come into sliding contact with individual electrostatic recording heads and press adjustment means for changing the pressure of electrostatic recording heads at the center when the aforesaid press means press the aforesaid recording medium against the surfaces of electrostatic recording heads, by supporting the aforesaid press means from both sides in the longitudinal direction of the respective electrostatic recording heads and moving the press means vertically while keeping the horizontal posture.

In this apparatus, the press adjustment means includes slide means for moving press means in the front-to-back direction of electrostatic recording heads to change the load of the aforesaid press means at the center of the aforesaid electrostatic recording heads.

In the above apparatus, the press adjustment means includes energizing means stretched so as to have a predetermined tension in advance for supporting a part of the load of the press means by the aforesaid tension when the press means are suspended.

In the above color electrostatic recorder, the press adjustment means includes a first member provided almost horizontally for supporting the press means from both sides thereof, a second member oscillatably linked almost perpendicularly to the first member, a third member oscillatably linked almost perpendicularly to the second member, disposed in almost parallel with the said first member and constituting a nearly U-shaped assembly together with the first and second members. The press adjustment means further includes pin means for oscillatably linking the second member and the third member, and, moreover, supporting the assembly so as able to oscillate on the main body of the electrostatic recorder. The pressure adjusting means further includes energizing means stretched between the first member and the third member so that a tension in an approaching direction of both members is generated in advance, relative-movement restriction means for restricting the mutual movement of the first member and the third member so that the distance between the tips of the first and third members is confined within a predetermined extent in the range where the tension in the energizing means is regarded as nearly constant. The pressure adjustment means further includes first drive means for revolving the second member around the pin means so that the first member slides in the front-to- back direction of electrostatic recording heads, and second drive means for revolving the third member around the pin means in a lifting direction in which the portion over which the energizing means is stretched moves upward.

In this apparatus, control means are provided for storing the control information related to the first and second drive means and control means are provided for reading out the information as needed and automatically setting the slide position of the first member and the oscillating position of the third member.

Also, information readout means are provided for reading out the information item recorded in a recorded medium concerning an appropriate pressure on the recording medium, and control means are provided for automatically setting the slide position of the first member and the vertical position of the third member on the basis of the information item read out by the information readout means.

In the above apparatus, the press means comprises a pad roller rotating with the conveyance of the recording medium in sliding contact with the electrostatic recording head.

According to the above arrangement, since the load of press means on an electrostatic recording head can be changed with a vertical movement of the press means by press adjustment means, to set the pressure of a recording medium coming into sliding contact with the electrostatic recording head during the recording at an appropriate value, the formation of desired electrostatic latent images will be secured, thereby enabling the occurrence of an image noise such as dropout or spurious writing to be effectively suppressed.

Also according to the above arrangement, since slide means changes the load of the press means at the center of an electrostatic recording head by moving the press means in the front-to-back direction of the electrostatic recording head, the load of the press means at the center of an electrostatic recording head can be changed with this slide operation even when the same load is applied over the whole electrostatic recording head. Consequently, the load at the center of the electrostatic recording head can be set at an appropriate value by adjusting the position of the press means in the front-to-back direction.

In addition, by using energizing means, such as e.g., a helical spring, for supporting a part of load on the aforesaid press means at a predetermined tension, the load subtracted from the weight of the press means by an amount corresponding to the tension of the energizing means can be arranged to be applied to the surface of the electrostatic recording head.

Furthermore, according to the above arrangement, since the first member and second member are oscillatably linked nearly perpendicularly to each other, the first member can slide in the front-to-back direction of an electrostatic recording head by rotating the second member around the pin means by the first drive means. In addition, since the first, second and third members, linked so as able to oscillate from each other, constitute a nearly U-shaped assembly, the energizing means is stretched between the first and third members so that a tension in an approaching direction of the both members is generated in advance, and further, the relative movement range of the first member and the third member is restricted to a predetermined extent by the relative-movement restriction means. The tension given in advance to the energizing means is applied to the first and third members as well if they are within this extent. The load of the press means onto the head may assume a state where the whole weight of the press means is applied, a state where the load resulting from the subtraction of the weight corresponding to the tension of the energizing means from the weight of the press means is applied, and a state where no weight of the press means is applied at all. By selecting not only any of the three states but also the position of the aforesaid slide means, the pressure of the recording medium coming into sliding contact with the center of the electrostatic recording head can be made an appropriate value, desired electrostatic latent images are formed and the occurrence of an image noise such as dropout or spurious writing can be effectively suppressed.

In addition, once an item of control information is stored, it is possible to adjust the press, by readout of this item of control information, to an appropriate value at the next time when printing is performed on the same recording medium, so that the burden of an operator is diminished.

Furthermore, for example, readout of an information item concerning the press stored as a bar code in a recording medium by information readout means such as bar code reader enables the press to be automatically adjusted, thereby diminishing the burden of an operator and promoting the efficiency of operation.

And, according to this arrangement, since the pad roller also rotates with the conveyance of a recording medium by taking a pad roller as the press means, the life of the press means is prolonged without rubbing together of the recording medium and press means. Morever, a suitable pressing action can always be exerted on the recording medium.

Alternatively, to attain the above object, a color electrostatic recorder of the single path system includes as many electrostatic recording heads and development means disposed in parallel as required for the recording of a color, and a series of operations including conveying a recording medium so as to come into sliding contact with the respective electrostatic recording heads to form an electrostatic latent image and developing it by development means are performed, in an electrostatic recording head and development means for each color, to finally obtain a color image. The electrostatic recording heads and development means are divided into a plurality of groups and the radius of surface curvature in an electrostatic recording head of a group situated downstream is made larger than that in an electrostatic recording head of a group situated upstream.

In this apparatus, each group situated at the upstream side and each one situated at the downstream include one or more electrostatic recording heads and development means.

With such an apparatus, four electrostatic recording heads and four development means are provided, which are grouped into two electrostatic recording heads and development means situated on the upstream side and two electrostatic recording head and development means situated on the downstream side. The two electrostatic recording heads belonging to each group are made equal in the radius of surface curvature and the radius of surface curvature in an electrostatic recording head belonging to the downstream group is made larger than the radius of surface curvature in an electrostatic recording head belonging to the upstream group.

Further, the radius of surface curvature is made larger for an electrostatic recording head on the farther downstream side among a plurality of electrostatic recording heads.

With a color electrostatic recorder of the single path system as described above, the pressure on the head surface on the downstream side with a larger tension tends to increase. Out of the tension of the recording medium perpendicular to the tangential direction of an electrostatic recording head, it is the vertical downward components which contribute to the pressure of the recording medium on the head surface, but the ratio of vertical downward components to the magnitude of a tension can be reduced by increasing the radius of surface curvature in an electrostatic recording head on the downstream side. Thus, to make the radius of surface curvature on the downstream side larger than on the upstream side enables an increase in the pressure of the recording medium on the head surface for an electrostatic recording head on the downstream side to be suppressed.

For example, with a color electrostatic recorder including four electrostatic recording heads corresponding to four primary colors and the respective development means corresponding thereto, all of which are divided into the upstream group of two electrostatic recording heads and the downstream group of two electrostatic recording heads, if the radius of surface curvature in an electrostatic recording head on the downstream side is made larger than on the upstream side, a change in the pressure of recording among four electrostatic recording heads can be suppressed within a definite extent and the occurrence of dropout or spurious writing can be effectively suppressed.

DETAILED DESCRIPTION OF THE PREFERRED EMBODIMENTS

Figure 1:
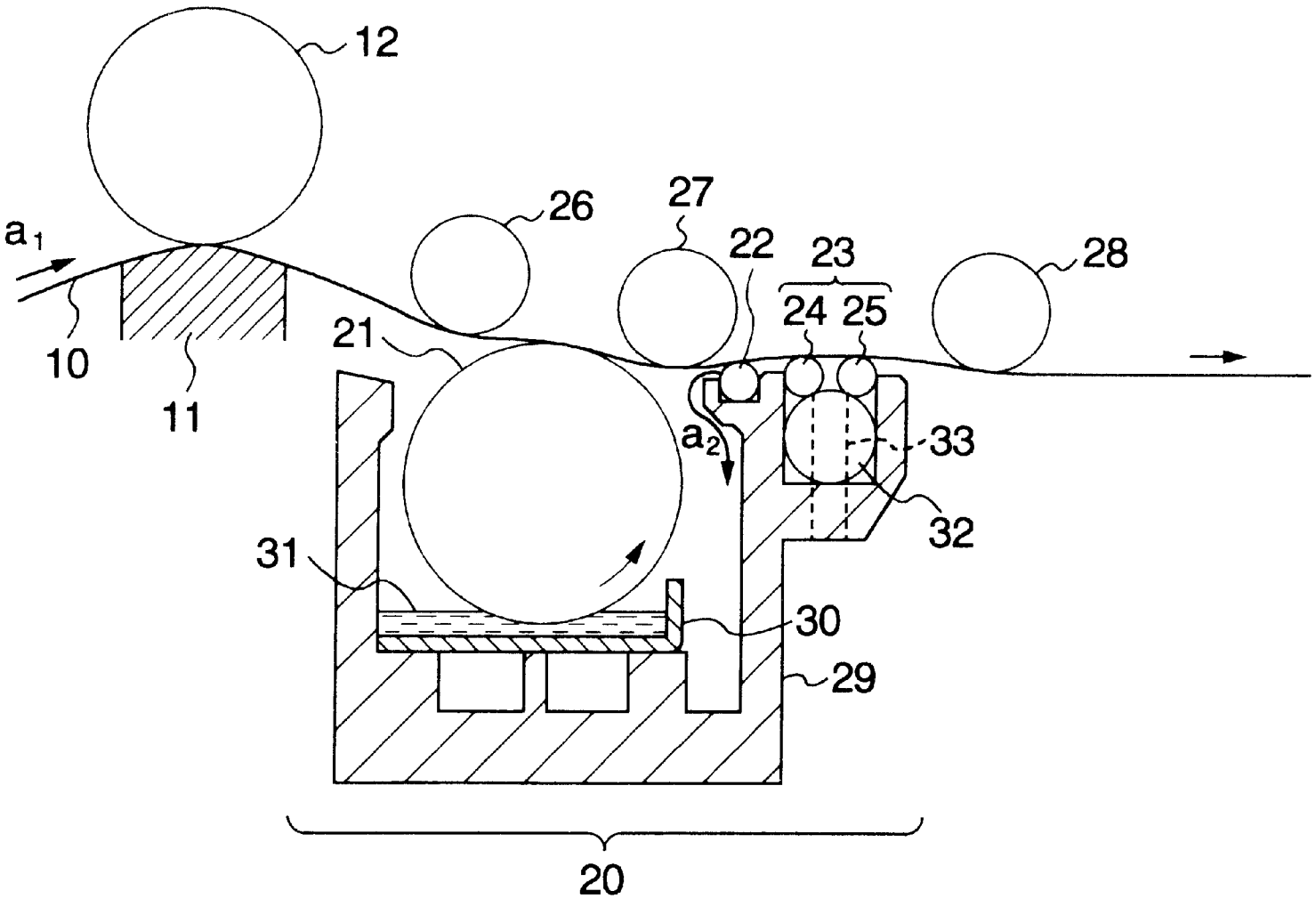
FIG. 1 is a schematic sectional view of a portion for accomplishing an image recording for one color in a color electrostatic recorder of the single path system according to one embodiment of the present invention.

Hereinafter, one embodiment of the present invention will be described referring to the drawings. FIG. 1 is a sectional view showing the outline of a portion for accomplishing an image recording for one color in a color electrostatic recorder of the single path system according to one embodiment of the present invention. In FIG. 1, a recording medium 10 on which an image is formed is conveyed in the direction indicated by the arrowhead a1 of FIG. 1 (subscanning direction) with a back tension applied thereto. The electrostatic recording head 11 serves to form an electrostatic latent image on the under face of the recording medium 10 conveyed in sliding contact therewith and is driven in accordance with the image signal fed from a predetermined signal processing circuit.

The pad roller 12, a part of a backrest mechanism mentioned later, presses the recording medium 10 against the side of the electrostatic recording head 11 and brings the recording medium into sliding contact with the electrode of the electrostatic recording head 11 under a moderate pressure.

On the record face (bottom side of FIG. 1) of the recording medium 10, a spacer including silica particles on the order of 5 to 30 $\mu$m in diameter is scattered at an adequate density. This spacer brings about discharge gaps between the electrostatic recording head and the dielectric layer in the recording medium. The recording medium is charged by discharge between the electrostatic recording head and the recording medium and an electrostatic latent image is formed.

The recording medium 10 having passed through the electrostatic recording head 11 is sent to the development section 20. At the development section 20, idle rollers 26, 27 and 28 for bringing the recording medium 10 into sliding contact with a toner roller 21 and a scraper 22 and with guide bars 24, 25 in the suction section 23 under an adequate pressure are provided on the top side of the recording medium 10. The scraper 22, the guide bars 24, 25 and a supporting member 32 for guide bars are fixed detachably on a case member 29 containing a toner roller 21 inside with a fixing member (not shown). With a color electrostatic recorder of the single path system, such electrostatic recording heads and develop sections are provided in series, e.g., as four steps and finally a color image is obtained by accomplishing a recording of the respective primary colors at individual steps.

A toner feed tray 30 situated below the toner roller 21 is filled with liquid toner 31 including toner particles distributed into a predetermined solvent to the level slightly beyond the lower end of the toner roller 21. This liquid toner is sent from a toner bottle through a predetermined route not shown to the toner feed tray 30 by a pump. Toner particles in the liquid toner 31 are charged in the opposite polarity to that of an electrostatic latent image. When the toner roller 21 is rotated anticlockwise, the liquid toner 31 is lifted along the groove on the surface of the toner roller 21 and applied to the under face of the recording medium 10 at the portion contacting the recording medium 10 in the toner roller 21. Toner particles in the liquid toner, sticking to the portion in which the electrostatic latent image is formed, are drawn to the electrostatic latent image formed on the recording medium by the electrostatic force and combined with the surface layer of the recording medium in a formed proportion of the electrostatic latent image, and the electrostatic latent image is developed.

If another-color image is recorded with the solvent of the liquid toner remaining on the recording medium 10 after one-color image is recorded, the color image quality deteriorates. For this reason, the toner remaining on the recording medium is removed after the development and, further, the solvent is dried with the aid of a blower device installed downstream the development section. With this embodiment, to remove the greater part of unnecessary liquid toner prior to drying with the blower device, the scraper 22 and suction section 23 are provided at the following step of the toner roller 21.

The scraper 22 is made of stainless steel rod-shaped member a little longer than the width of the recording medium 10 and the section is a circle of about 5 mm diameter. The shaft of a scraper 22 is fixed at the case member 29 so as to cross the progressing direction of the recording medium at right angles.

The scraper 22 scrapes off the greater part of unnecessary liquid toner remaining on the recording medium by the sliding of the recording medium 10 thereon. The scraped off liquid toner drops off along the inner wall of the case member as indicated with the arrow $a_2$. On the other hand, the suction section 23 is given to a negative pressure in the space between the guide bars 24 and 25 below the recording medium 10 with the aid of a pump (not shown) connected through the suction path 33 thereto, and accordingly, the liquid toner remaining on the recording medium is sucked therefrom.

Figure 2:
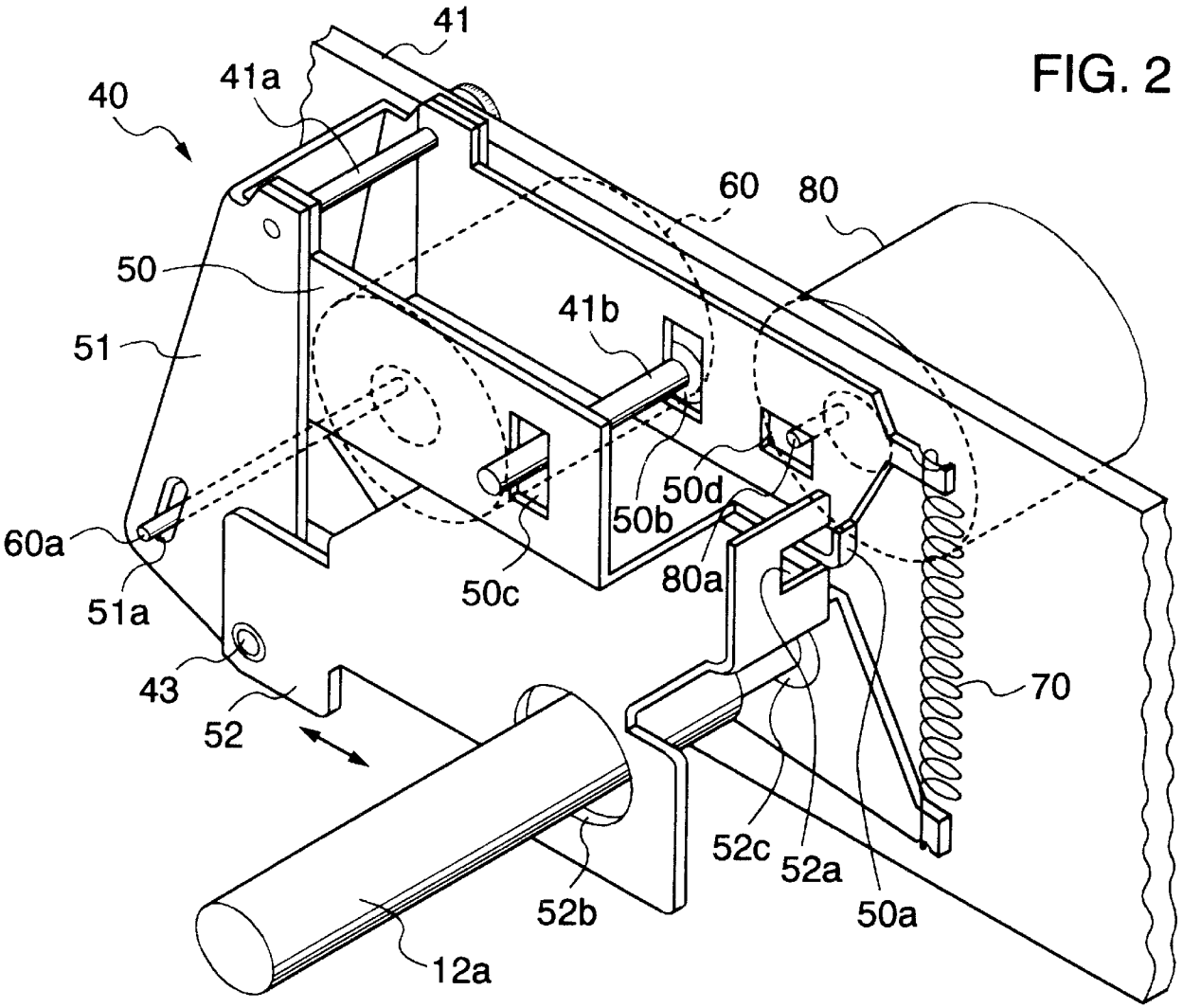
FIG. 2 is a schematic perspective view of a backrest mechanism for adjusting the pressure of a pad roller on an electrostatic recording head in an image recording portion as shown in FIG. 1.

Next, the backrest, the main section of this embodiment, will be described. FIG. 2 is a schematic perspective view of a backrest mechanism for supporting the pad roller 12 shown in FIG. 1 and adjusting the pressure of a pad roller on the surface of an electrostatic recording head. Incidentally, the backrest mechanism on one side alone is shown in FIG. 2, but actually, a like mechanism constructed in a side-to-side symmetrical manner to this is also provided on the other side of the electrostatic recorder and supports the shaft 12*a* of the pad roller 12 from both sides.

In FIG. 2, the backrest mechanism 40 is retained oscillatably on the side wall member 41 of the main body of the electrostatic recorder with pin 41*a*. The backrest mechanism 40 has metal fittings 50, 51, 52. The metal fittings 50 and 51 and the metal fittings 51 and 52 are linked oscillatably with the aid of pins 41*a* and 43, respectively, and the metal fitting 52 is made slidable in the front-to-end direction (arrow direction). As mentioned above, however, it is sufficient for this sliding distance to be on the order of 3 to 4 mm in consideration of the inter-electrode distance in the subscanning direction. In addition, the metal fittings 50, 51 and 52 are all intensified by making the sectional form into a U-shaped. The metal fittings 50 and 51 are formed to fit into the metal fittings 51 and 52 without a gap, respectively for the prevention of side-to-side twist. The rotational shaft 12*a* of the pad roller 12 penetrates the opening 52*b* provided on one side face of the metal fitting 52 and is supported rotatably by a ball bearing (not shown) on the opening 52*c* provided on another side face.

An output shaft 60*a* inserted in a long hole 51*a* provided on the metal fitting 51 is fixed at a position off-centered from the rotational shaft of a stepping motor 60 fixed on the side wall member 41. When the stepping motor 60 rotates, the output shaft 60*a* oscillates the metal fitting 51 around the pin 41*a* and at the same time slides the metal fitting 52 linked with the metal fitting 51 in the front-to-back direction.

The vertical extent that the metal fittings 50 and 51 can relatively move is regulated by the metal fitting 51 on one hand and by the crooked portion 50*a* provided at the tip of the metal fitting 50 and the cutaway portion 52*a* in the tip of the metal fitting 52 into which this crooked portion 51*a* is inserted on the other side. In the latter, metal fittings 50 and 52 approach at the nearest and separate at the remotest when the crooked portion 52*a* butts against the lower end and the upper end of the cutaway portion 52*a*, respectively. Also, the front-to-back slidable extent of the metal fittings 50 and 52 is restricted by the crooked portion 50*a* and the cutaway portion 52*a*.

A spring 70 between the tip of the metal fitting 50 and the tip of the metal fitting 52 is used which has a spring constant and size so that the tension to make the metal fittings 50 and 52 nearer amounts to about a quarter of the whole weight of the pad roller 12 when the spring is stretched as shown in FIG. 2. That is, a tension equal to about a quarter of the whole weight of the pad roller 12 is given in advance to the spring 70. Hereinafter, this will be referred to as pretension. Thus, in cooperation with another spring on the other side, the metal fittings 50 and 52 are energized with a tension of about a half of the whole weight of the pad roller 12.

Figure 3:
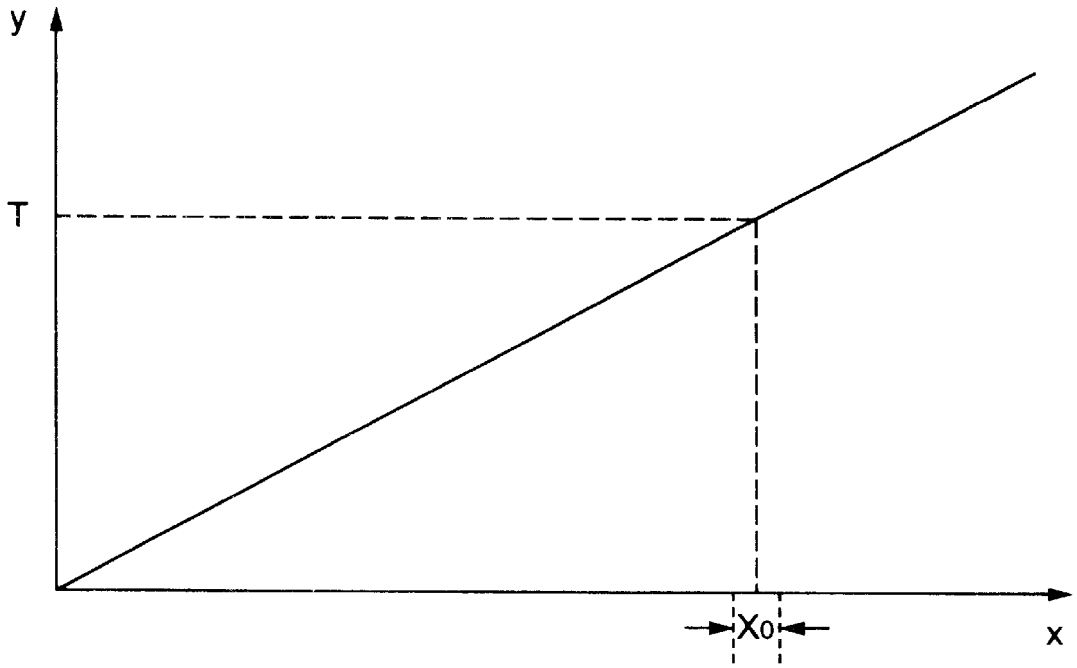
FIG. 3 is a characteristic graph of a spring with the elongation of the spring taken along the x-axis (axis of abscissa) and the tension taken along the y-axis (axis of ordinate) in the backrest mechanism of FIG. 2.
Figure 4A:
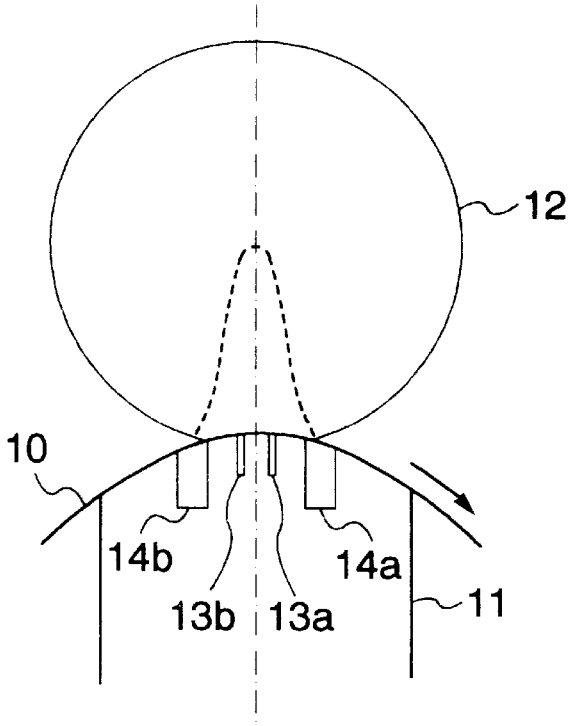
FIGS. 4A and 4B are schematic sectional views of the portion of a backrest mechanism using a pad roller.
Figure 4B:
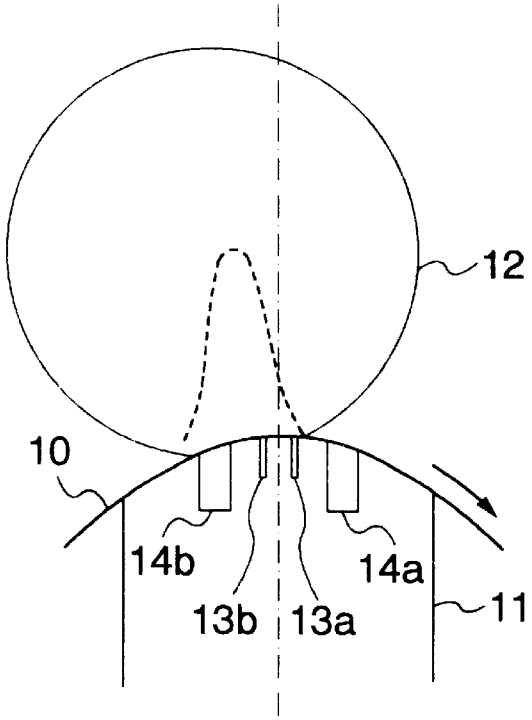

FIG. 3 is a characteristic graph of a spring 70 with the elongation of the spring taken along the x-axis (axis of abscissa) and the tension taken along the y-axis (axis of ordinate). The gradient of the straight line in FIG. 3 corresponds to the spring constant of the spring 70. To the spring 70, a pretension is given by elongating it to a predetermined length and stretching it between the tip of the metal fitting 50 and that of the metal fitting 52. Meanwhile, relative movement of metal fittings 50 and 52 is confined within a narrow extent shown by $X_0$ in FIG. 3 by the crooked portion 50*a* and cutaway portion 52*a*. For this reason, within this relative moving extent, a tension by the spring 70 can be regarded as a nearly constant value equal to the tension T given as the pretension.

In the openings 50*b* and 50*c* provided on both walls of the metal fitting 50, the pin 41*b* fixed on the side wall member 41 of the main body is inserted thereinto. By this pin 41*b* and the openings 50*b*, 50*c*, the oscillating extent of the whole backrest mechanism 40 with the pin 41*a* made as a center axis is restricted.

On the side wall member 41 of the main body, another stepping motor 80 is further fixed, at which an output shaft 80*a* parallel thereto and off-centered therefrom is provided. The off-centered output shaft 80*a* of the stepping motor 80 is inserted in a rectangular opening 50*d* provided in the metal fitting 50. When the output shaft 80*a* makes contact neither with the upper end nor with the lower end of the opening 50*d*, the crooked portion 50*a* butts against the lower end of the cutaway portion 52*a*. The whole backrest mechanism 40 can oscillate with the pin 41*b* made as a center axis. Consequently, the whole weight of the pad roller is applied to the electrostatic recording head (not shown) positioned therebelow.

When the stepping motor 80 rotates, the out put shaft 80*a* butts against the upper end of the opening 50*d* and the metal fitting 50 is lifted at an overhang state around the pin 41*a*, the crooked portion 50*a* comes into a floating state between the lower and upper ends of the cutaway portion 52*a*. At that time, the pretension mentioned above is given to the spring 70 and its tension becomes a predetermined constant value mentioned above. Thus, due to spring 70 and an equivalent spring on an opposite side, the load corresponding to about a half of the whole weight of the pad roller is applied to an electrostatic recording head. In addition, at that time, by giving a pretension to the spring 70, even when the load applied to the electrostatic recording head is switched from the whole weight of the pad roller to a half thereof, the tension of two springs on both sides becomes equal. Accordingly a situation wherein that the load applied to the electrostatic recording head differs at both ends of the pad roller can be effectively prevented.

When the stepping motor 80 rotates further and lifts the metal fitting 50 higher, the crooked portion 50*a* butts against the upper end of the cutaway portion 52*a*, the whole metal fitting 52 assumes a lifted state and the pad roller floats from the electrostatic recording head perfectly. At this time, the stepping motor 80 lifts the pad roller by its own force. In this way, three kinds of loading states of the pad roller can be assumed by the rotational position of the stepping motor 80.

If the slide position of the metal fitting 52 and three loading states of the pad roller 12 are determined, the pressure of the pad roller 12 against the electrostatic recording head is also determined correspondingly. Moreover, by selecting any of three loading states of the pad roller 12 and adjusting the slide position of the metal fitting 52, the pressure of the recording medium in the center of the electrostatic recording head is adjustable over a wide range at no step. Thus, by adjusting the loading state of the pad roller 12 and the slide position of the metal fitting 52 so that the pressure of the pad roller becomes appropriate, an image noise such as dropout or spurious writing can be effectively prevented.

The present invention is not limited to the embodiment mentioned above, but may be subjected to various modifications and variations within the scope of the purport thereof. For example, as mentioned above, an appropriate pressure of the electrostatic recording head differs with types of recording media, but an appropriate value of pressure is previously known for a plurality of recording media used, the loading state of the pad roller 12 and the sliding position of the metal fitting 52 corresponding to this press can be set. Accordingly for the reduction of the operator's burden, it is possible to store the items of information about appropriate values of press somewhere in a recording medium, e.g., with a bar code, and to read them with a bar code reader, to control the stepping motors 60 and 80 by control means and to automatically set the loading state of the pad roller 12 and the slide position of the metal fitting 52. In addition, it is possible to store this information in the memory, to read it out according to the need to control the stepping motors 60 and 80 by control means, to automatically set the loading state of the pad roller 12 and sliding position of the metal portion 52.

As described above, according to the present invention, since the pressure of the press means against the head becomes adjustable and the pressure applied to a recording medium coming into sliding contact with the head can be set at an appropriate value, a desired latent image is reliably formed and occurrence of an image noise such as dropout or spurious writing can be effectively suppressed. In particular, since the front-to-back position of the press means and the vertical loading state can be changed, the pressure of the press means is variable under a high degree of freedom. Thus, it is possible to select an appropriate pressure enabling an effective prevention of dropout or spurious writing, so that a backrest mechanism in an electrostatic recorder promotes image quality Moreover, an appropriate image recording is possible by a flexible correspondence with various recording media differing in property.

In addition, with the above color electrostatic recorder, in executing a recording for one color, a recording medium 10 comes into sliding contact with the electrostatic recording head 11, the backrest 12, the toner roller 21 and the idle rollers 26, 27 and 28, and is subjected to a downward suction force in the suction section 23. Since these serve as a resistance to the winding force of the recording medium, the tension of the recording medium after leaving the suction section 23 becomes larger than that of the recording medium before entering the recording head 11.

Figure 5:
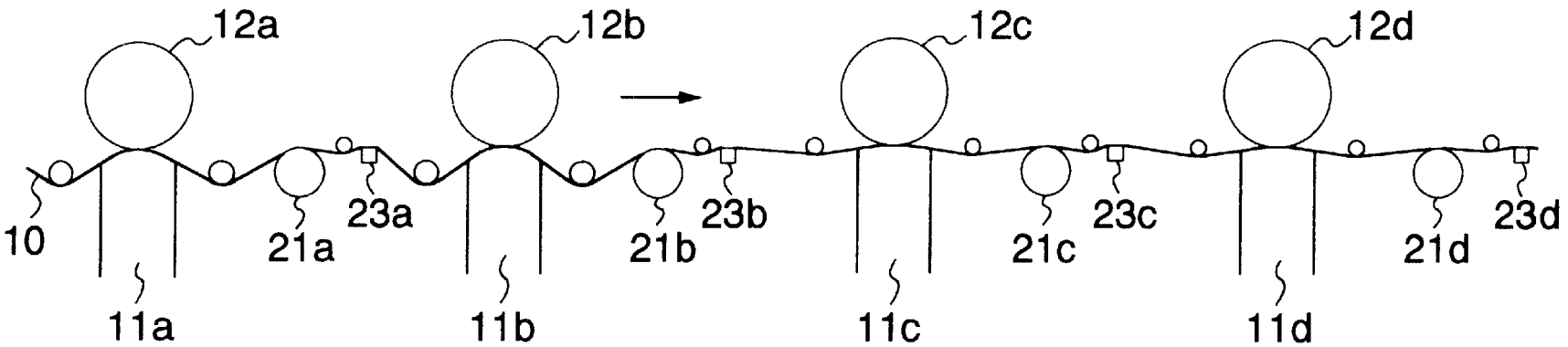
FIG. 5 is a schematic sectional view of the portion for conducting an image recording for each of four primary colors in the color electrostatic recorder.

FIG. 5 is a sectional view showing the outline of the portion for conducting an image recording for each of four primary colors, cyan, magenta, yellow and black, in which electrostatic recording heads 11, toner rollers 21 and suction sections 23 shown in FIG. 1 are provided at four steps in series. The recording medium 10 is conveyed downstream under application of back tension by a arrow-directioned tension based on the winding force which is larger than the back tension. In the course of conveyance, the recording medium makes sliding contact with electrostatic recording heads 11*a* to 11*d*, toner rollers 21*a* to 21*d*, suction sections 23*a* to 23*d* and further numbers of pad rollers for pressing the recording medium 10 against these devices from above. Since these act as resistance to the winding force, the tension applied to the recording medium increases accordingly as the medium is conveyed downstream.

Accordingly, the pressure on the head surface of the recording medium dependent on the magnitude of vertical downward component of the tension also increases as the recording medium is conveyed downward, so that dropout is apt to occur upstream and spurious writing is apt to occur downstream.

Meanwhile, the inventor noticed that the vertical downward component of the tangential force on the head surface depends on the radius of curvature in the head surface, in the case where portions the recording medium contacts are equal in length to each other. To be concrete, with larger radius of curvature in the head surface, the vertical downward component decreases and consequently the pressure on the surface of the recording medium 10 on the head surface decreases. On the other hand, with smaller radius of curvature in the head surface, the vertical downward component increases and consequently the pressure on the surface of the recording medium 10 on the head surface increases. Thus, even if the tension is large as seen on the downstream side, a reduction of the vertical downward component can lead to a decrease in pressure on the head pressure of the recording medium. Such being the case, with this embodiment, the radius of surface curvature in two electrostatic recording heads 11*a* and 11*b* on the upstream side was made small and the radius of surface curvature in two electrostatic recording heads 11*c* and 11*d* on the downstream side was made large.

Figure 6A:
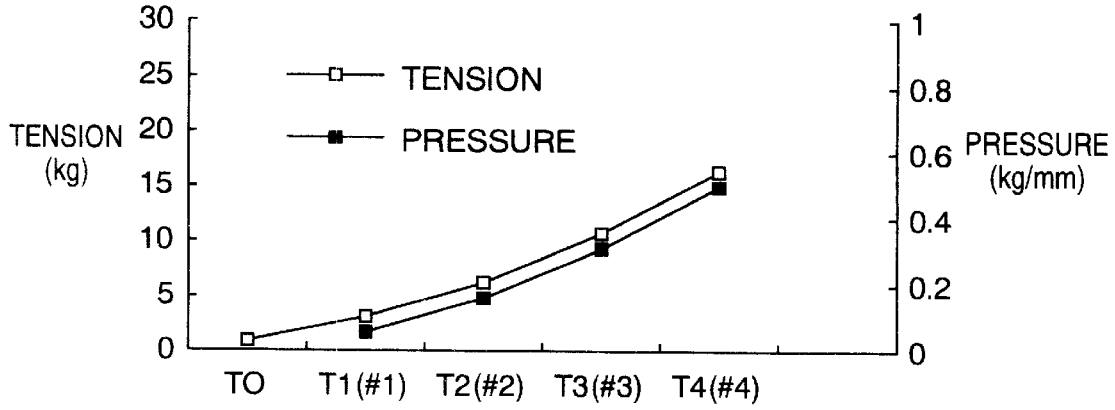
FIGS. 6A and 6B are graphs showing a change in tension of the recording medium and pressure of the recording medium on the surface of a head for individual electrostatic recording heads, corresponding to a case where the radius of surface curvature in electrostatic recording heads is equal and a case where the radius of surface curvature in electrostatic recording heads is made larger on the downstream side, respectively.
Figure 6B:
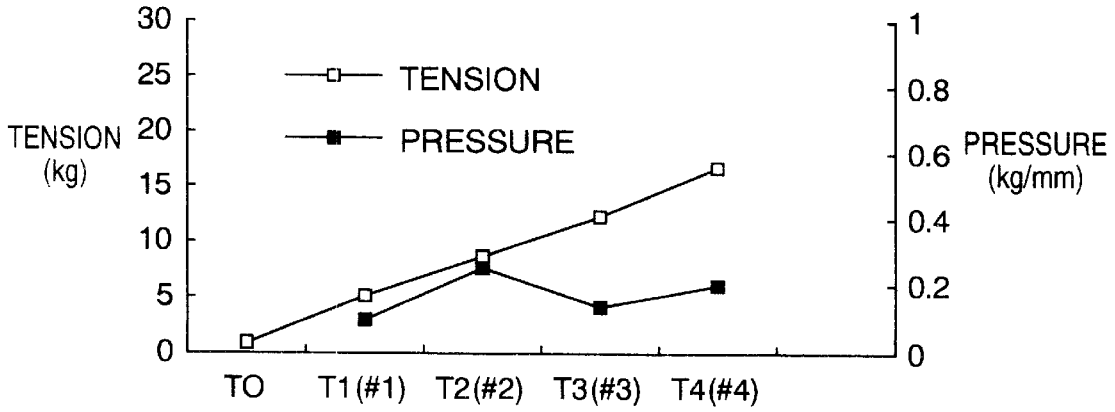

FIGS. 6A and 6B are graphs showing a change in tension of the recording medium (white open representation, in kg unit) and pressure of the recording medium on the surface of a head (black representation, in kg/mm unit) for individual electrostatic recording heads, corresponding to a case where the radius of surface curvature in electrostatic recording heads is equally set at 23.5 mm and a case where the radius of surface curvature is set at 23.5 mm in the electrostatic recording heads 11*a* and 11*b* on the upstream and set at 65 mm in the electrostatic recording heads 11*c* and 11*d* on the downstream side as shown in FIG. 5. Herein, the plot in $T_0$ is the measured value of tension in the recording medium before reaching the recording section, and those in $T_1$, $T_2$, $T_3$ and $T_4$ are the measured values of tension on the recording medium and pressure against the head surfaces in individual electrostatic recording heads 11*a*, 11*b*, 11*c* and 11*d*.

As shown in FIG. 6A, when the radii of surface curvature in electrostatic recording heads are equal, there is a high correlation between a change in pressure of the recording medium on individual head surfaces and the tension of the recording medium. In contrast to this, as shown in FIG. 6B, by making the radii of surface curvature in the two downstream electrostatic recording heads 11*c* and 11*d* larger, an increase in pressure of the recording medium on the two downstream electrostatic recording heads 11*c* and 11*d* is suppressed and the pressure on head surfaces of the four electrostatic recording heads 11*a* to 11*d* can be confined within a fixed extent. In consequence, occurrence of dropout or spurious writing for certain colors to be recorded can be effectively prevented and it becomes possible to maintain a finally obtained color image at a high quality.

Incidentally, the present invention is not limited to the embodiment mentioned above, but may be subjected to various changes and modifications within the scope of the purport thereof. With this embodiment, for example, because of an ease of fabrication and an sufficient image quality obtained in experiments, the two upstream electrostatic heads and the two downstream electrostatic heads were respectively made equal in radius of curvature, but radii of surface curvature in heads may be gradually increased from upstream to downstream.

As described above, according to the present invention, by making the radius of curvature for the downstream ones larger than for the upstream ones among a plurality of electrostatic recording heads, an increase in the pressure of a recording medium coming into sliding contact with heads on head surfaces of downstream electrostatic recording heads can be suppressed.

Thus, in the single path system, a color electrostatic recorder wherein a change in pressure during the recording for individual electrostatic recording heads becomes nearly constant or a change in pressure can be confined within a predetermined extent and occurrence of dropout or spurious writing can be effectively prevented.

INDUSTRIAL APPLICABILITY

A color electrostatic recorder according to the present invention comprises a backrest mechanism for bringing a recording medium into sliding contact with an electrostatic recording head under a moderate pressure and so arranged that the radii of surface curvature in electrostatic recording heads are made larger for the downstream side of the recording medium. This color electrostatic recorder is of a single-pulse system in which a plurality of electrostatic recording sections are provided and a color image can be obtained on the recording medium by passing the last electrostatic recording section.

We claim:

1. A color electrostatic recorder comprising, recording heads conveyed in sliding contact with a recording medium for forming electrostatic latent images, development means provided in pairs to the electrostatic recording heads for developing said electrostatic latent images, and means for adjusting the sliding contact of the recording medium with said electrostatic recording heads, wherein said electrostatic recording heads and development means are disposed and provided at such a number as required for color image recording.

2. The color electrostatic recorder as set forth in claim 1, wherein said sliding contact adjustment means are individually provided at mutually different radii of surface curvature for said electrostatic recording heads and the pressure of said electrostatic recording heads at the center is made adjustable.

3. The color electrostatic recorder as set forth in claim 1, comprising a single path system in which a plurality of pairs of electrostatic recording heads and development means are disposed in series and a color image can be finally obtained by forming and developing the electrostatic latent images for the respective colors in individual pairs.

4. The color electrostatic recorder as set forth in claim 2, wherein the radii of surface curvature in said electrostatic recording heads are made larger for the downstream side in the moving direction of the recording medium than for the upstream side.

5. The color electrostatic recorder as set forth in claim 1, wherein a backrest mechanism in that sliding contact adjustment means comprise press means for pressing the recording medium against the surfaces of electrostatic recording heads and press adjustment means for changing the press of the relevant electrostatic recording heads by said press means at the center.

6. The color electrostatic recorder as set forth in claim 1, wherein a plurality of pairs of electrostatic recording heads and development means are grouped according to the moving direction of the recording medium and a radii of surface curvature in said electrostatic recording heads are made larger for a downstream group than for an upstream group.

7. A color electrostatic recorder of a single path system comprising;

recording heads conveyed in sliding contact with a recording medium for forming electrostatic latent images, and development means for developing said electrostatic latent images, wherein electrostatic recording heads and development means are disposed in series as required for color image recording, a color image being obtainable by using said electrostatic recording heads and development means, and wherein said electrostatic recording heads and development means are grouped into a plurality of groups and radii of surface curvature in said electrostatic recording heads are made larger for a downstream group in the moving direction of the recording medium than for an upstream group.

8. The color electrostatic recorder as set forth in claim 7, wherein said group situated upstream and said group situated downstream comprise one or more electrostatic recording heads and development means.

9. The color electrostatic recorder as set forth in claim 7, wherein four of said electrostatic recording heads and four of said development means are provided, which are grouped into two pairs of electrostatic recording heads and development means situated upstream and two pairs of electrostatic recording heads and development means situated downstream, and the two electrostatic recording heads belonging to each group are made equal in the radius of surface curvature and moreover the radii of surface curvature in electrostatic recording heads belonging to the downstream group are made larger than those belonging to the upstream group.

10. The color electrostatic recorder as set forth in claim 7, wherein the radius of surface curvature is made the larger for an electrostatic recording head situated at the farther downstream side.

11. A color electrostatic recorder comprising:

electrostatic recording heads conveyed in sliding contact with a recording medium for forming electrostatic latent images;

development means for developing said electrostatic latent images; and a backrest mechanism for adjusting the sliding contact of said recording medium with said electrostatic recording heads, wherein said backrest mechanism comprises press means for pressing the recording medium against surfaces of said electrostatic recording heads by their loads so that record faces of said recording medium come into sliding contact with electrostatic recording heads, and press adjustment means for changing a pressure of electrostatic recording heads at a center of said recording heads when said press means presses said recording medium against surfaces of said electrostatic recording heads, by supporting the relevant press means from both sides in a longitudinal direction of said electrostatic recording heads and moving the press means vertically while keeping a horizontal posture.

12. The color electrostatic recorder as set forth in claim 11, wherein said press adjustment means comprises slide means for moving press means in a front-to-back direction of electrostatic recording heads to change the load of said press means at the center of said electrostatic recording heads.

13. The color electrostatic recorder as set forth in claim 11, wherein said press adjustment means comprises energizing means stretched so as to have a predetermined tensile force in advance for supporting a part of the load of said press means by said predetermined tensile force when said press means are suspended.

14. The color electrostatic recorder as set forth in claim 11, wherein said press adjustment means comprises, a first member provided almost horizontally for supporting said press means from both sides thereof;

a second member oscillatably linked almost perpendicularly to said first member, a third member oscillatably linked almost perpendicularly to said second member, disposed in almost parallel with said first member and constituting a nearly U-shaped assembly together with said first and second members, pin means for oscillatably linking said second member and said third member and moreover oscillatably supporting said assembly on a main body of the electrostatic recorder, energizing means stretched between said first member and said third member so that a tensile force in an approaching direction of the both members is generated in advance, relative-movement restriction means for restricting the mutual movement of said first member and said third member so that a distance between tips of said first and third members is confined within a predetermined extent in the range where said tensile force in said energizing means is regarded as nearly constant first drive means for revolving said second member around said pin means so that said first member slides in a front-to-back direction of electrostatic recording heads, and second drive means for revolving said third member around said pin means in a lifting direction that the portion over which said energizing means is stretched moves upward.

15. The color electrostatic recorder as set forth in claim 14, further comprising, control means for storing control information related to said first and second drive means, and control means for reading out said information according to the need and automatically setting a slide position of said first member and an oscillating position of said third member.

16. The color electrostatic recorder as set forth in claim 15, further comprising, information readout means for reading out the information item recorded in a recorded medium concerning an appropriate pressure of said recording medium, and control means for automatically setting the slide position of said first member and a vertical position of said third member on the basis of the information item read out by said information readout means.

17. The color electrostatic recorder as set forth in claim 11, wherein said press means comprises a pad roller rotating with the conveyance of the recording medium in sliding contact with said electrostatic recording head.

18. The color electrostatic recorder as set forth in claim 2, wherein a plurality of pairs of electrostatic recording heads and development means are grouped according to a moving direction of the recording medium and the radii of surface curvature in said electrostatic recording heads are made larger for a downstream group than for an upstream group.

19. The color electrostatic recorder as set forth in claim 3, wherein a plurality of pairs of electrostatic recording heads and development means are grouped according to a moving direction of the recording medium and the radii of surface curvature in said electrostatic recording heads are made larger for a downstream group than for an upstream group.

20. The color electrostatic recorder as set forth in claim 8, wherein four of said electrostatic recording heads and four of said development means are provided, which are grouped into two pairs of electrostatic recording heads and development means situated upstream and two pairs of electrostatic recording heads and development means situated downstream, and the two electrostatic recording heads belonging to each group are made equal in the radius of surface curvature and moreover the radii of surface curvature in electrostatic recording heads belonging to the downstream group are made larger than those belonging to the upstream group.

21. The color electrostatic recorder as set forth in claim 12, wherein said press adjustment means comprises energizing means stretched so as to have a predetermined tensile force in advance for supporting a part of the load of said press means by said predetermined tensile force when said press means are suspended.

22. The color electrostatic recorder as set forth in claim 12, wherein said press means comprises a pad roller rotating with the conveyance of the recording medium in sliding contact with said electrostatic recording head.

23. The color electrostatic recorder as set forth in claim 13, wherein said press means comprises a pad roller rotating with the conveyance of the recording medium in sliding contact with said electrostatic recording head.

24. The color electrostatic recorder as set forth in claim 14, wherein said press means comprises a pad roller rotating with the conveyance of the recording medium in sliding contact with said electrostatic recording head.

25. The color electrostatic recorder as set forth in claim 15, wherein said press means comprises a pad roller rotating with the conveyance of the recording medium in sliding contact with said electrostatic recording head.

26. The color electrostatic recorder as set forth in claim 16, wherein said press means comprises a pad roller rotating with the conveyance of the recording medium in sliding contact with said electrostatic recording head.

* * * * *